United States Patent [19]

Casey et al.

[11] 4,428,505

[45] Jan. 31, 1984

[54] SAND CLASSIFICATION PLANT WITH PROCESS CONTROL SYSTEM

[75] Inventors: Paul G. Casey, Hinesburg; Robert F. Dawson, South Burlington, both of Vt.

[73] Assignee: Hinesburg Sand and Gravel Company, Hinesburg, Vt.

[21] Appl. No.: 380,911

[22] Filed: May 21, 1982

[51] Int. Cl.[3] ..... B67D 5/08

[52] U.S. Cl. ..... 222/64; 222/644; 222/144.5

[58] Field of Search ..... 222/52, 55, 56, 64, 222/23, 30, 129, 132, 133, 144.5; 209/156, 157, 158

[56] References Cited

U.S. PATENT DOCUMENTS

| | | | |
|---|---|---|---|
| 3,114,479 | 12/1963 | Keeney | 222/64 |
| 3,123,252 | 3/1964 | Kuntz | 222/1 |
| 3,129,849 | 4/1964 | Cochran | 222/64 |
| 3,160,321 | 12/1964 | Cochran | 222/64 |
| 3,467,281 | 9/1969 | Archer | 222/644 |
| 3,913,788 | 10/1975 | McCauley | 222/64 |
| 4,199,080 | 4/1980 | Keeney | 222/23 |

*Primary Examiner*—Joseph J. Rolla
*Assistant Examiner*—Michael S. Huppert

[57] ABSTRACT

Disclosed is a sand classification plant dynamically controlled to divide feed material from a primary and a secondary source among several stations by particle-size and to blend the station contents in selected ratios to produce one or more controlled products having respective particle-size distributions and one or more uncontrolled distribution by-products. The invention includes automated features such as regulating the ratio between two or more controlled products to optimize the use of feed material, regulating source material feed and water flow rates to optimize production, combining two or more stations to make up for the missing output of an empty one, and controlling the flow rates from the individual stations in accordance with changes in feed particle-size distribution and in particle-size distribution of the output from each individual station.

12 Claims, 2 Drawing Figures

SAND CLASSIFICATION PLANT WITH PROCESS CONTROL SYSTEM

BACKGROUND AND SUMMARY OF THE INVENTION

The invention is in the field of classifying granular materials into several stations by particle-size distribution and reblending the station contents into end products having selected particle-size distributions. As a particular example, the invention relates to granular materials such as sand and gravel and to producing controlled products for end uses such as in particular types of concrete and filter media.

A sand classification plant typically uses feed material mined in nature and extracts from it the constituents suitable for a particular end use. For example, the feed material is segregated by particle size into several stations, each for a respective particle-size distribution, and the contents of selected stations are blended in selected ratios to produce a given controlled product having a selected particle-size distribution. The classification into stations by particle size can be by techniques such as wet or dry screening, hydraulic classification and hydrocyclone separation. Examples of prior art techniques are proposed in U.S. Pat. Nos. 3,114,479; 3,160,321; 3,467,281; 3,913,788 and 4,199,080.

The desirable characteristics of a sand classification plant include optimized use of feed material, so that most of it goes into the controlled product and as little as possible into waste by-product, the ability to produce controlled products of any selected particle-size distribution, close tolerances in the particle-size distribution of the controlled product, minimum manpower and energy demands, high reliability in continuous use in an adverse environment, the ability to use feed material whose nature is difficult to control, etc. While the prior art proposals identified above, as well as other known prior art proposals, evidence a long-standing need to provide these and other desirable characteristics, it is believed that this has not been done in a fully satisfactory way and that much need remains for doing so. Accordingly, the invention is directed to arranging and operating a sand classification plant to enhance the desirable and suppress the undesirable characteristics thereof and to provide features not attained in the known prior art.

In a nonlimiting example of an embodiment of the invention, a material classifier is fed with source material from at least a primary source and has several stations each receiving material constituents characterized by respective particle-size distributions. Sensors detect the presence of material at the respective stations, and valves control the flow of material from the respective stations to at least one controlled material outlet and at least one by-product outlet. Process control means respond to signals from the sensors and to the particle-size needs of at least one controlled product to open or close selected valves at times and for intervals causing material having the needed particle-size range to flow into the controlled material outlet. Means are provided to allow for communication between a plant operator and the process control means.

The classifier can be fed with additional source material from at least one secondary material source. The classification process can be hydraulic, with the help of at least partly recirculated water. In one example the classifier has 12 stations each receiving material characterized by a respective particle-size distribution. Two or more controlled material outlets can be used, each for controlled material having a respective selected particle-size distribution, and one or more by-product outlets can be used, each receiving its respective kind of by-product. The rate of flow from each respective feed source and water source into the classifier can be controlled, e.g. through a suitable material grate opening or a gate or valve arrangement, and the flow from each respective station in the classifier can similarly be controlled, e.g. through a respective valve or gate. The sensors can detect the presence of at least a predetermined quantity of material at each respective station, but the system can alternately or in addition use sensors which provide additional information as to the amount of material present at each respective station. In addition, sensors can be used at the outlets of one or more of the stations to provide an instantaneous measure of the respective particle-size distributions of material coming out of the respective stations. The system can control the absolute and relative feed rates of feed materials, the flow rate of primary water to carry sand through the classifier, the absolute and relative flow rate of water recycled through the classifier, the valve and gate opening times for valves assigned to a particular product (to assure a specified gradation for each product) and the proportional relationship between valve opening times at each station (to control the relative production levels of the products).

DETAILED DESCRIPTION

Figure 1:
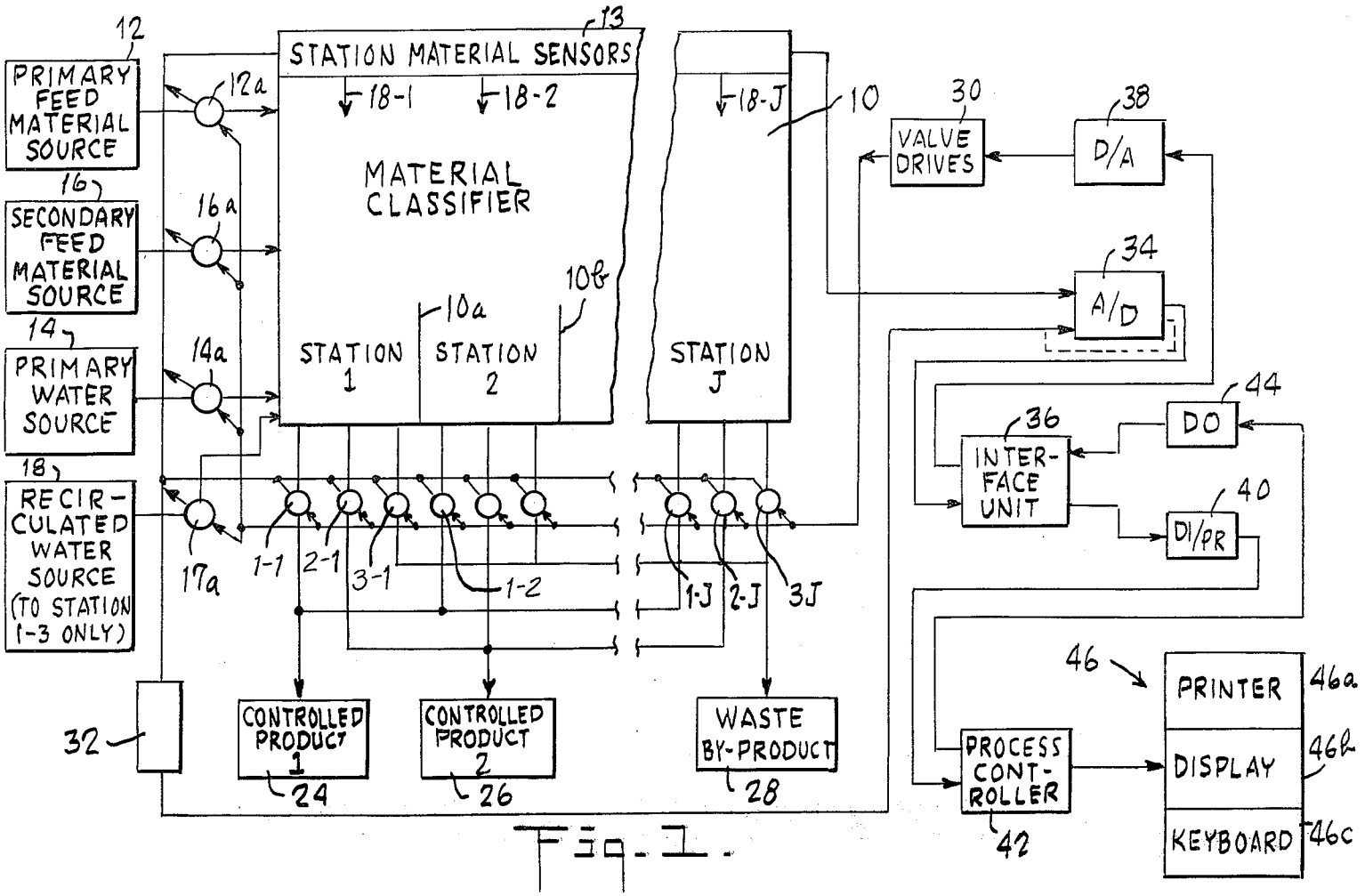
FIG. 1 is a partly schematic and partly block diagram illustrating an embodiment of the invention.

Referring to FIG. 1, a material classifier 10 receives feed from a primary feed material source 12 and primary water from a source 14, and can additionally receive feed from one or more secondary feed material sources such as 16 and from a recirculated water source 17. The flow of material from source 12 is controlled by valve or gate 12*a*, the water flow from sources 14 and 17 is controlled by valves 14*a* and 17*a*, respectively, and the flow of material from each of the secondary sources such as 16 is controlled by a valve or gate 16*a*. Material classifier 10 receives the feed material and water in the form of a slurry flowing from left to right as seen in the drawing such that the larger and heavier particles tend to settle upstream from the lighter and finer ones. The water which has served its purpose can flow out at the righthand end of the classifier and can be recirculated through source 17 and valve 17*a*. Suitable baffles, such as 10*a*, 10*b*, etc. can extend partway up from the classifier bottom and divide it into a number of stations (j), such as station 1, station 2, . . . , station J, each of which receives particles having a respective particle-size distribution. In a particular example, there are 12 stations, which need not be of equal size: e.g., stations 1 and 2 can occupy less classifier volume than the others. The material classifier includes sensors generally indicated at 18 which comprise a respective sensor for each respective station: sensor 18-1 for station 1, 18-2 for station 2, etc. The purpose of each sensor is to detect when at least a predetermined amount of material has accumulated in its respective station. For example, each sensor can comprise a paddle at the lower end of a shaft projecting a selected distance down the classifier and rotated by a motor until there is enough particulate material to increase the torque acting on the paddle past a level indicating that the predetermined amount of material has accumulated. In the alternative, there can be two or more such sensors per station, each having a paddle at a different depth in the classifier such that the lowermost paddle is stopped when a predetermined amount of material has accumulated, the next one is stopped when a greater predetermined amount of material has accumulated, etc. Each of the stations has several outlets each controlled by a respective valve. In the particular illustrated example, station 1 has outlets controlled by respective valves 1-1, 2-1 and 3-1, station 2 has respective outlets controlled by respective valves 1-2, 2-2 and 3-2, etc. Valves 1 when open allow material from their respective stations to flow into a flue 24 for controlled product 1, valves 2 when open allow material from their respective stations to flow into a flue 26 for controlled product 2 and valves 3 when open allow material from their respective stations to flow into a flue 28 for (uncontrolled) product 3. Additional valves can be provided to allow flow into one or more additional controlled product and/or by-product flues. Each of valves 1, 2 and 3 can be opened or closed by a control signal from valve drives 30. In addition, one or more of valves **12*a*, 14*a*, 16*a* and 17*a* can be opened or closed or can have their rates of flow controlled by respective control signals from valve drives 30. Each of one or more of valves 12*a*, 16*a* and 1, 2 and 3 can be provided at their outlets with respective particle-size sensors which provides signals indicative of the instantaneous particle-size distribution of material flowing out of the respective valve. The particle-size sensors are collectively indicated at 32, and their measurement signals, if in analog form, are supplied to an analog-to-digital converter 34 and, if in digital form, are supplied directly to an interface unit 36, which communicates, through a digital-to-analog converter 38, with valve drives 30. Analog-to-digital converter 34 additionally receives the outputs of material quantity sensors 18 for the respective stations, and respective signals from valves 12*a*, 14*a*, 16*a* and 17*a* indicative of the flow rates therethrough. Interface unit 36 processes the signals from analog-to-digital converter 34 and supplies them to a unit 40 which comprises the data input and priority request terminals of a process controller 42 and whose output control signals are supplied, through data output terminals 44, to the same interface unit 36. Communication between a plant operator and process controller 42 is through a unit generally indicated at 46 and comprising one or more of a printer 46*a*, a television screen display 46*b*, and a keyboard or similar data and command input device 46*c***.

In typical operation, source 12 supplies feed material mined in nature and feed souce 16 can supply material which has a selected particle-size distribution which is needed in blending the controlled products but is deficient in the feed from source 12. The feed from source 12 and/or source 16, after passing through valve **12*a* and/or valve 16*a*, is formed into a slurry by water from source 14 and/or 17 passing through valve 14*a* and/or 17*a* and is introduced into material classifier 10, where the constituents of the feed settle, by particle size, into stations 1 through J. Once enough material has accumulated in the needed ones of stations 1 through J, the system blends station contents in the required manner to produce one or more controlled products flowing into flues 24 and/or 26 in accordance with controlled product particle-size distributions specified in process controller 42. Assuming for simplicity that feed material and water flow into classifier 10 at constant rates, process controller 42 determines when the stations needed for particular controlled product particle distribution have sufficient material accumulated in them, and opens the appropriate ones of valves 1, 2 and 3 as needed to provide the proper blend. Specifically, station material quantity sensors 18 provide output signals to A/D converter 34, indicating, in one example, whether each of the respective stations has a predetermined minimum quantity of material, and the digital output of converter 34 is supplied to process controller 42 through interface unit 36 and through data input/priority requests terminal 40. When process controller 42 determines that the stations needed for a particular control product have sufficient material, it sends digital control signals through data output terminals 44 and interface unit 36 into digital-to-analog converter 38, the analog output of which operates the appropriate portion of valve drives 30 to open the station valves necessary to provide the required blend. As a simplistic example, if the particle size distribution of controlled product 1 should be equivalent to 20 percent of the particle distribution of station 1, 30 percent of that of station 2 and 50 percent of station J, then process controller 42 keeps valves 1-1, 1-2 and 1-J open in a time ratio which corresponds to a mass flow ratio of 2/3/5 between stations 1, 2 and J, for as long as each of these three stations has a sufficient material in it to provide the required mass flow. In this simplistic example, if it develops that the three required stations are empty while the rest of the classified area is full, process controller 42 can: (i) if possible, make up for the missing output of the empty stations 1, 2 and J by blending the outputs of other stations, then open the appropriate valves at the times necessary to do so, (ii) feed in secondary material from source 16 if this would help supply material to the three necessary stations without overflowing the others or, (iii) open the valves necessary to send some or all of the contents of the other stations into by-product flue 28**.

More specifically, assume as a nonlimiting example that a plant operated in accordance with the invention has a primary and a secondary material feed, a primary and a recirculated water source, and twelve stations each having an outlet to controlled product 1, another outlet to controlled product 2, and a third outlet to a product 3 which is uncontrolled (a waste by-product). The system can start by having for each controlled product a product design made up of the mass fractions from the respective stations needed to make up one mass unit of the respective controlled product. Since the mass flow rate through each station outlet valve is known, or can be measured and does not change rapidly, this readily translates to a product design made up of the relative times over which the respective station outlet valves need to be open to make a unit of the respective controlled product. Thus, for each controlled product and each respective station outlet valve, a required open time REQ(i,j) can be specified, in time interval units relative to the required open times of the other station valves needed for that product. For example, the required open time REQ(i,j) of the valve from station (j) to product (i) can be in terms of the number of seconds out of each 25-second cycle. Once this basic product design information is available, plant operation can start. As an overview, plant operation is organized in this particular example in 25-second cycles at the end of each of which various updates are made, on the basis of the averages of the last four 25-second cycles, which change as needed the required relative times of the respective station outlet valves so as to optimize the production level for controlled products despite changing conditions. Such operation continues, with dynamic adjustment to changing conditions, until the plant operator decides to stop it. Each 25-second cycle is made up of ten repeating 2.5-second cycles.

For each 2.5-second cycle the system determines if material is available at each of the twelve stations and, if so, whether the station can be used directly for blending into either one of the two controlled products. If so, the system finds out which of the two controlled products has greater need for this material, and opens the appropriate valve to feed that station to the needy controlled product for a time interval which is up to 2.5 seconds but can be shorter either because the needy controlled product requires less material than 2.5 seconds worth of outflow from that station or because the station runs out of material. At the end of the 2.5 seconds, and assuming the 25-second cycle has not ended, the system repeats the same process. Thus, the same station can alternate every 2.5 seconds or multiples thereof between supplying material to the two controlled products such that, for practical purposes, substantially concurrent flow of the two controlled products can be provided.

If at the start of a 2.5-second cycle the system finds that neither of the two controlled products has need for materials from a given station, it then finds out if that station's material can be used as a component in a blend to be substituted for the material which should come directly from another station but cannot because it is empty at the moment. In such case, the system looks for stations whose material is in demand but which are unable to supply it at the moment and, if there are two or more such stations, finds out which one is more deficient in material and whether its normal output can be replaced by a blend from stations all of which at the moment are not needed to directly supply the controlled products, and uses such a blend to make the substitution.

At the end of each 25-second cycle, the system rechecks the various operating conditions and revises process parameters as needed to maintain optimum production over the next 25 seconds. If quality control information is available, such as from a test of the actual particle-size distribution of the controlled products or from automated measurements of instantaneous particle-size distributions, and if the test shows a discrepancy between the actual and desired distributions, then the system makes a quality control adjustment which dynamically revises the relative required open times of the relevant station outflow valves so as to have the actual controlled products come closer to the desired particle-size distributions. If no quality control information is available, then the system revises the balance as between the production rates of controlled product 1 and controlled product 2 as needed based on the history over the past 100 seconds to ensure that production of the third, uncontrolled product is indeed at a minimum level and that the feed is optimally utilized. At the same time the system finds if over the last 100 seconds any stations have delivered excess or deficit material to the respective controlled products so that suitable adjustments can be made for the next 25-second cycle, finds if there is any need to change the rate at which secondary feed is supplied to the classification plant to supplement typically deficient particle-size distribution components of the primary feed, and finds if there is a need to revise the rate at which primary feed is supplied to the tank and the rates at which primary and recycled water are supplied. After these revisions, the system again cycles through 25 seconds of opening and closing valves to make controlled products in accordance with the new settings, and repeats the process until stopped by the plant operator.

A nonlimiting example of the master sequence of events for operating the exemplary classification plant illustrated in FIG. 1 in accordance with the invention is illustrated in Appendix 1 at the end of this specification. The process starts at line 10 by opening a control data file which, as indicated at line 12, contains cycle control parameters defining, in this example, a subcycle of 2.5 seconds, a cycle of 25 seconds, a long-term cycle of 100 seconds and a balancing interval of 300 seconds. Of course, these are examples and other cycle durations can be selected within the scope of the invention. The significance of the different parameters will become apparent from the description below. At line 14 the initial product mix parameters are established for each of the two controlled products. For example, for product 1 these parameters can be the respective times in seconds during which the respective stations should feed their contents into product 1 over a 25-second cycle. Since the rate of flow, in units of mass per unit of time, through an open valve remains constant over a long period of time, the required open times readily translate to tons of material from the respective stations during a 25-second cycle. An exemplary way of deriving the product mix parameters is discussed below in connection with Appendix 2. At line 16 station blending data is established, e.g. as discussed below in connection with Appendices 3 and 11. This comes into play if in plant operation it turns out at a particular time that a station whose output is needed is empty and the system makes an attempt to make up for the needed but unavailable output of a particular station by blending the outputs of two or more other stations that happen to have enough material at the time, so as to optimize utilization of the feed material and minimize the production of waste by-product. At line 18 water/feed balance is established, e.g. as discussed below in connection with Appendix 4, to select the initial mix of feed material and primary and recycled water.

At line 20 in Appendix 1, preparation for a plant operation commences, and includes, as indicated at lines 22, 24 and 26, deactivating all station sensors, closing all station outflow valves and resetting all station sensor interrupts. At this time the plant is not producing any products because all station outflow valves are closed and cannot be opened in response to a material-available interrupt from a station sensor as the station sensors are deactivated. Plant operation commences after line 28 in Appendix 1, by attaching the tasks indicated at lines 30, 32 and 34. Attaching in this case means making the tasks available so that they can respond to the respective interrupts which initiate their actual operation. Specifically, at line 30 the station outflow valve control tasks, one for each of the twelve classifier stations, are attached, to control operation as discussed below in connection with FIG. 2, at line 32 a quality control task is attached to operate as discussed below in connection with Appendix 5, and at line 34 a product balancing task is attached to operate as discussed below in connection with Appendix 6.

At line 36 a do loop commences and continues until a halt interrupt is posted by the plant operator, e.g. through keyboard 46c in FIG. 1. At line 38 within the do loop, the system posts a newset interrupt to thereby initiate the operation of the procedure discussed in connection with Appendix 7 for revising the various plant settings in accordance with changing conditions and for activating valve washers used on some outflow valves of the classification tank so that the valves can start supplying material to the respective products when opened. At line 42 a long-term control cycle, in this example 100 seconds, commences. As indicated in line 44 the inside loop is repeated four times (4, 25-second cycles) to make up one long-term control cycle of 100 seconds. At line 46 the system sets a 25-second timer to run, and also sets a 2.5-second timer which runs through ten repeating subcycles at the end of each of which it posts a station-empty interrupt to simulate a station sensor output occurring when the station has insufficient material in it to feed any product. The significance of the simulated station-empty interrupt will become apparent in the discussion below of FIG. 2. At line 48 the system activates all station sensors to thereby enable those which belong to stations with enough material in them to provide a material-available interrupt for the procedure discussed below in connection with FIG. 2. As indicated at line 50, the system then waits for the 25-second timer to expire and then, at line 52, deactivates the station sensors so they cannot provide to the system either station-empty or material-available interrupts, and at line 54 updates for each product (i) and each station (j) a variable designated ACTM for the just ended 25-second cycle. This variable is the actual cumulative time over which the respective valve remained open during the just ended 25-second cycle. At line 56 the system resets the station sensor interrupts to enable the commencement of another 25-second cycle and at line 58 checks whether changes in plant settings, such as changes due to the newset task of Appendix 7 or changes entered by the plant operator through keyboard 46c, are ready to be incorporated into the system. As indicated at line 60, if the changes are not ready, the system goes to line 64. As indicated at line 62 if indeed such changes are ready, then they are applied to the respective plant settings, in the manner discussed below, and the label changes is set to not ready for the next test at line 58. At line 64 the 25-second loop ends, and at line 66 the necessary interrupt to call a material/-product update task is posted, to call into operation the task discussed below in connection with Appendix 8. At line 68 the necessary interrupt is posted to call the task newset discussed below in connection with Appendix 7, so as to provide new plant settings. During the execution of the newset task, the valves of several of the stations are washed with water jets to provide material fluidity by assuring proper material viscosity. At line 70 a report of the operation up to this time is printed for the plant operator, and the system cycles through the operations identified at lines 36 through 70 until the plant operator posts a halt interrupt to stop the plant, at which time the system stops at line 74.

Plant operation in accordance with this example of the invention is thus organized in 25-second cycles each made up of ten 2.5-second cycles. Each station can supply material to a respective product continuously for up to a complete 2.5-second subcycle, but depending on need and on material availability can supply material to a given product for less than the complete 2.5-second subcycle, or for none of it. For the next 2.5-second subcycle and depending on need, the same station can continue supplying material to the same product for up to 2.5 seconds, or it can supply material to another product for up to the complete new 2.5-second cycle.

Figure 2:
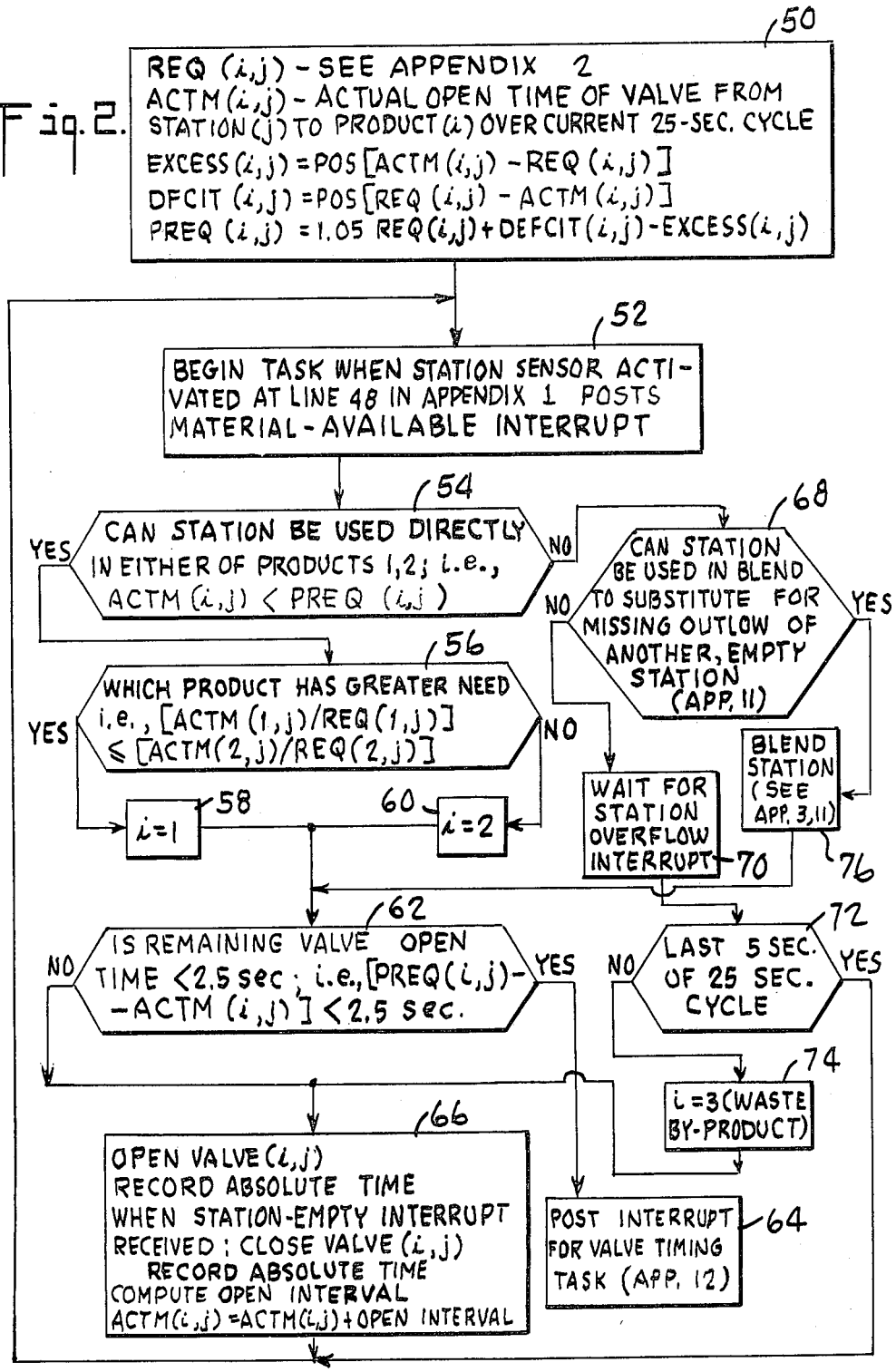
FIG. 2 is a flowchart of the sequence of major steps in a station valve control task embodying an example of a portion of the invention.

The opening and closing of station outflow valves in accordance with the invention is illustrated in FIG. 2 in flowchart form, in a task which can commence at the time the station sensors are activated as indicated at line 48 in Appendix 1, and actually commences when the station for the respective station provides a material-available interrupt. This interrupt can come at the start of the 25-second cycle, at some point within the cycle or it may not come at all during the cycle, depending on material availability at the station. There are twelve tasks identical to the one illustrated in FIG. 2, one for each of the twelve stations of the exemplary classifier illustrated in FIG. 1.

The procedure illustrated in FIG. 2 makes use of the parameters shown in block 50 thereof. The parameter REQ(i,j), which can be derived as discussed below in connection with Appendix 2, is the time in seconds over which station (j) should supply product (i) during the upcoming 25-second cycle. The parameter ACTM(i,j) is the cumulative actual open time of that valve over the current 25-second cycle, this quantity being updated each 2.5-second subcycle, as discussed below in connection with step 66 of FIG. 2. The parameter EXCESS-(i,j) is the positive difference between the two indicated parameters over the last four 25-second cycles, and the parameter DFCIT(i,j) is the positive difference between the two indicated parameters over the same 100 seconds. The parameter PREQ(i,j) is derived in accordance with the indicated relationship. Note that if the sum of the actual open times of the valve in question over the last eleven 25-second cycles and the PREQ for the upcoming one is greater than the sum of the REQ times over the same 300 seconds, the PREQ for the upcoming 25-second cycle is reduced to make the 300-second quantities equal.

The procedure of FIG. 2 actually commences when the respective station sensor after being activated at line 48 of Appendix 1 at the start of a 25-second cycle, posts a material-available interrupt. Then, at step 54, the system makes a test to determine whether this station can be used directly in either of products 1 or 2. This test can be whether the actual time the valve has supplied material to product 1 and to product 2 during this 25-second cycle is less than the respective time PREQ(i,j) for this 25-second cycle. In case of a positive answer, meaning that the station should supply some more material to either product 1 or product 2 (these being the controlled particle-size gradation products) the system makes another test at step 56 to determine which of the two controlled products has greater need for material from this station. This test can be whether the ratio of the actual to required supply time from this station to product 1 during the current 25-second cycle is less than or equal to the same ratio for product 2. A positive result of this test means that product 1 has greater need for this station's material at this time (in case of a tie, product 1 is preferred). Thus, in case of a positive result the index (i) is set to one at step 58 to indicate that the station should supply its material to product 1 through its valve 1, and in case of a negative result the system at step 60 sets the same index to two. Another test is made at step 62, to determine if the remaining time in this 25-second cycle during which the selected valve from this station should remain open is less than 2.5 seconds. This test can be whether the difference between the current values of the quantities indicated at step 62 is less than 2.5 seconds. In case of a negative result, meaning that the valve in question should remain open for a period longer than the next 2.5 seconds in order to satisfy the need for material from this station during the current 25-second cycle, the system goes directly to step 66. In case of a negative result, meaning that for the current 25-second cycle this particular valve should remain open for a time interval less than the next 2.5 seconds, the system goes to step 64 to post an interrupt to initiate the valve timing task discussed below in connection with Appendix 12, so that the procedure of Appendix 12 can post a simulated station-empty interrupt for use at step 66 of FIG. 2 at sometime within the 2.5-second subcycle which is about to begin. The system then goes to step 66, where it supplies the appropriate signal through the circuitry illustrated in FIG. 1 to open the valve in question, and records the absolute clock time this occurred. When a station-empty interrupt is received, the system closes the valve in question and records the absolute time this occurred. The station-empty interrupt can be received due to any one of the following three events: (i) the station sensor detects that in fact there is no material in the station at question, (ii) the 2.5-second subcycle has expired, and the timer for it has posted a simulated station-empty interrupt (see line 46 of Appendix 1), and (iii) in case the system has gone through step 64 of FIG. 2, the procedure of Appendix 12 has posted a simulated station-empty interrupt (see line 16 of Appendix 12). Returning to step 66 of FIG. 2, the open interval is computed by subtracting the absolute time of opening from the absolute time of closing of the valve in question, and the quantity ACTM, meaning actual open time of the valve in question during the current 25-second cycle, is updated as indicated. The system then returns to step 52 and, provided there is still enough material in the station in question to allow its sensor to keep posting a material-available interrupt and provided the sensor has not been deactivated to prevent it from providing this interrupt, it again runs through the indicated steps of FIG. 2. When the system reaches step 56 for the second 2.5-second subcycle, the step 56 test may determine that now the other product has greater need, in which case the valve supplying the other product will be open when the system next reaches step 66.

If at any time the test at step 54 shows that this particular station has supplied the needs for both controlled products, it goes to step 68 for a test of whether the material from this particular station can be used in a blend to substitute for the missing outflow of another station whose material is needed at the moment for a controlled product but cannot be supplied because at the moment this other station is empty. If the test at step 68 yields a negative result, meaning that the station cannot be used in such a blend, the system goes to step 70 to wait for a station-overflow interrupt from the station sensor which detects when the material in the station has reached a level near the top of the classification tank, and makes a test at step 72 to determine if it is now within the last five seconds of the current 25-second cycle. If it is, chances are that the tank will not overflow in the next five seconds, and the system returns to step 52. If it is not in the last five seconds of the current 25-second cycle, there is danger that the particular station may overflow within the current 25-second cycle, and the system goes to step 74 to set the product index to three (the waste by-product) and goes to step 66. Of course, this time the valve which is opened through the procedure of step 66 is that leading to the waste by-product. If the test at step 68 determines that the station can indeed be used in a blend to substitute for the missing output of another station, the system goes to step 76 to make use of the station with available material as discussed in connection with Appendices 4 and 11.

To recap, once a 25-second cycle is initiated as discussed in connection with Appendix 2, for each respective station the system initiates a 2.5-second cycle as soon as the sensor for that station indicates that it has enough material. During this 2.5-second subcycle, the station supplies material to the needier one of the two controlled products and, if neither needs material, the system finds out if this station's material can be used in a blend to substitute for the missing output of another, empty station. If so, the system finds which stations are empty and need it, and makes the substitution for the empty station whose missing output is in greatest need provided that the other components needed for the blend to make up this particular missing outflow, have available material after they have satisfied their own requirements for the current 25-second cycle. If a particular station has satisfied the need of the controlled products during the current 25-second cycle, and cannot be used in a blend to substitute for the missing output of another station, the station with available material dumps material to the waste by-product if it is within the first 20 seconds of a 25-second cycle, so as to avoid physical overflow but, provided it is within the last five seconds of the 25-second cycle, saves its contents for possible use in a controlled product in the next 25-second cycle. At the end of a 25-second cycle, the system checks its performance over the last 100 and 300 seconds, as well as various parameters such as information on changes in the feed, in the desired make-up of the controlled products or in deviations from those desired characteristics of the controlled products, makes appropriate corrections for such changes, and commences another 25-second cycle.

As noted in connection with step 50 in FIG. 2, one of the starting parameters for a 25-second cycle is the quantity REQ(i,j), which is the time during the 25-second cycle valve (i) of station (j) should remain open. This quantity can be derived in accordance with the invention as indicated in Appendix 2, which applies to deriving the necessary information for one product. Input 1 is the desired gradations of the product in question, and is determined by the ultimate use of the product. In this example the specification is made up of twelve gradations, but of course a different number of gradations can be used within the scope of the invention. Input 2 in Appendix 1 is the actual gradations of the material at the respective stations, this information being available from actual measurements made once the classification tank reaches steady-state operation or from instantaneous measurements of the station's outflow made with commercially available equipment. Input 3 is the rate of material outflow from a given station and is available from actual measurements, it being understood that a valve is either completely open or completely closed and its flowrate does not change appreciably over time. Input 4 is the available material at a given station. This can be derived by averaging the actual open times of valves from this station over the last four 25-second cycles and knowing the material outflow rate per valve. If this much material flowed over the last averaged 25-second cycle, chances are that at least that much material will be available over the next 25-second cycle. Input 5 is the permissible deviation of the gradations in the desired product and can be set, e.g., at 0.5% for each gradation. The desired result is derived by a minimization of the indicated quantity Z using known linear programming techniques to find the quantities T(j) which minimize the quantity Z for the indicated 48 conditions. The end result is the respective times that valves from the respective stations should remain open over the next 25-second cycle to supply material needed to make the product in question. This, of course, translates to the quantity REQ(i,j) where (i) is the product in question.

As noted in connection with Appendix 1, line 16, and in connection with FIG. 2, step 76, it is possible in accordance with the invention to substitute, for the missing output of a station which happens to be empty at the time needed for a controlled product, a blend of the materials from two or more other stations (and in some cases it is possible to make a direct substitution by using the material from a single other station). A procedure in accordance with the invention for finding what station or stations can be used to substitute for the missing output of another is illustrated in Appendix 3. The inputs for the Appendix 3 procedure include the gradations of the material expected from the empty station and for the materials from the other 11 stations (see Appendix 2, input 2), the material flowrates from the respective stations (see Appendix 2, input 3) and the amount of blended material to be used in the substitution, e.g. the quantity W(N) which is the output normally provided by the now empty station for a 1-second interval. As with Appendix 2, the derivation is through a linear programming minimization of the indicated quantity Z subject to the indicated conditions. The result is the set of quantities BT(j), which is the set of times the respective outflow valves of the respective stations (j) other than the station N must remain open in order to blend 1-second worth of the normal output from the now empty station N. An example of the results, as applied to a particular plant and settings therefor, is illustrated in Appendix 11 discussed below.

The water/feed balance referred to in connection with Appendix 1, line 18, can be derived in accordance with the invention as indicated in Appendix 4, where the feed (or MAT) in tons/hour can be found as indicated in paragraphs 1–4 of Appendix 4, when the plant is in steady-state operation. Appendix 4, paragraph 5, illustrates one particular set of water/feed balance conditions which have been empirically found to be satisfactory. In the table of Appendix 4, paragraph 5, the feed is the sum of primary and secondary feed materials and, for stations 1, 2 and 3, the first figure is the percent opening of the recycled water valve which supplies upward flow of recycled water into stations 1, 2 and 3, and the second figure is the percent opening of the material outflow valves for stations 1, 2 and 3 in the case of the particular classification tank used at Hinesburg Sand and Gravel Company in Hinesburg, Vt. at the time of execution of this patent application.

The quality control task referred to in connection with Appendix 1, line 32, is illustrated in Appendix 5 and serves the purpose of finding the changes in the required valve open times for a 25-second cycle in order to bring the products actually produced closer to the products which are desired to be produced in accordance with the invention. The inputs to the procedure of Appendix 5 are the station gradations (as in Appendix 2, input 2), the desired product gradation specifications, the actual product gradations, as measured from steady-state operation of the controlled plant either by making a one-time sample of the particular product of interest or by instantaneous measurements carried out by conventional equipment attached to the product outlet, the desired gradation change which is the difference between the quantities which are inputs 2 and 3, the material outflow rates from the station valve (as in Appendix 2, input 3), and the total valve opening times per station per 25-second cycle averaged over the last four 25-second cycles. The derivation is similarly through a linear programming minimization of the indicated quantity under the indicated conditions, and the result is the changes needed to be made in the previously found required valve open times REQ(i,j) so that the system can adjust the plant's operation over the next 25-second cycle for operation closer to the optimum.

The product balancing task referred to in connection with Appendix 1, line 34, is illustrated in Appendix 6 and serves the purpose of finding the relative shares of the two controlled products, in tons/hour, which should result in optimum utilization of the feed and minimum production of waste by-product. The inputs to the procedure are the available rates of flow through the respective valves of the respective stations, the time T(i,j) over which the outflow valve in question should remain open in the next 25-second cycle in order to provide material corresponding to the product mix parameters found in Appendix 2, and the quantity MAT(j) which is the material which flows out of station (j) into any product in the 25-second cycle averaged over the last four such cycles. The sought result is found by linear programming maximizing of the indicated quantity subject to the indicated conditions.

The newest task referred to in connection with Appendix 1, lines 38 and 68 is illustrated in Appendix 7 and serves the purpose of arranging for new plant settings, found as a result of the procedures performed at the end of each 25-second cycle, to be derived and implemented. Referring to Appendix 7 the procedure is initiated at line 10 in response to the interrupt provided at Appendix 1, line 38, and the system provides at Appendix 7, line 12 a reset so that the next interrupt can be properly treated. Lines 121, 122, 341 and 342 provide for the earlier noted washing of certain station outflow valves to facilitate flow of material through them. At line 14 the system checks if the plant operator has posted a halt, for the purpose of stopping the plant operation, in which case the procedure goes to its end. Otherwise, at line 16 the procedure of Appendix 7 carries out an operation called ENQ DATSET, which causes the system to carry out the remainder of the procedure of Appendix 7 without making any changes in plant settings until the procedure is over. At line 18 the system checks if a quality control flag is posted by the plant operator, e.g. through keyboard 46c in FIG. 1, to indicate that quality control information such as used in the procedure of Appendix 5, are available. If such results are available, then line 20 calls the quality control task of Appendix 5, after which the system goes to line 22 of Appendix 7 after making appropriate use of the results of the procedure of Appendix 5. If the procedure of Appendix 5 uses instantaneously available quality control information from on-line measurement devices, it can be run, once every 25 seconds. If no quality control flag has been posted at line 18 of Appendix 7, the system goes to line 24 to commence the updating procedures discussed earlier. Thus, at line 24 a product balancing task implementing the procedure of Appendix 6 is called and executed, at line 26 an interrupt is posted to initiate the execution of a historical adjustments tank discussed below in connection with Appendix 9, at line 28 an adjust interrupt is posted to call and execute a feed adjustment task discussed below in connection with Appendix 10, and at line 30 a water/feed balance task implementing the procedure discussed in connection with Appendix 4 is called and executed. After the procedures referred to in connection with Appendix 7, lines 20, 24, 26, 28 and 30 have been executed, the new settings provided thereby are released to the system at line 32 and at line 34 the label change is set to yes or to ready so that the master sequence of Appendix 1, line 58 can commence making the changes in plant settings for use in the upcoming 25-second cycle, and the procedure of Appendix 7 ends at line 36 thereof.

The material/product update task referred to in connection with Appendix 1, line 66 is illustrated in Appendix 8 and commences with the update interrupt provided by the master sequence of Appendix 1. In response to receiving this update interrupt at line 10, the task of Appendix 8 resets that update at line 12 and at line 14 executes the instruction which prevents the system from making use of the parameters being updated until the updating is completed. At line 16 the procedure of Appendix 8 increments the cycle indices of a circular file for a 100-second period made up of the last four 25-second cycles, this circular file containing the actual open times for the respective valves over the respective cycle, and at line 18 computes new 100-second totals of actual open times for all station/-product combinations (same as material/product combinations). At line 20 new 300-second cycle totals are computed for the respective station/product (or material/product) combinations, at line 22 the newly computed information is released for use by the system, and the procedure ends at line 24.

The historical adjustments task referred to in connection with Appendix 7, line 26 is illustrated in Appendix 9 and commences at line 10 with the interrupt posted by the Appendix 7 procedure. At Appendix 9, line 12 the system issues the instruction to prevent use of the relevant information while it is being updated, and at line 14 computes the excesses or deficits, whichever is applicable, for the 100-second cycle made up of the last four 25-second cycles for each station/product (or material/product) combination in accordance with the relationships indicated at line 14 and lines 16 and 18. At line 20 the procedure of Appendix 9 updates the quantity PREQ(i,j) as indicated, for use in the next run through the sequence of FIG. 2 (see FIG. 2, box 50), and releases the newly updated parameters and ends at line 22.

The feed adjustment task referred to in Appendix 7, line 28 is illustrated in Appendix 10 and commences with the interrupt provided by the Appendix 7 task. At Appendix 10, line 12 the system prevents use of the parameters being updated while they are being updated and at lines 14 and 16 computes the two indicated quantities, based on the actual open times of the indicated valves over the 100 seconds made up of the last four 25-second cycles, and computes their ratio at line 18. At line 20 the system checks if the computed ratio is less than a fixed %, e.g., 99.5% of the same ratio found on the basis of the required rather than actual valve open times and, if so, issues a command to increment the secondary feed by opening secondary feed valve 16*a* (FIG. 1) by a fixed amount, e.g. 5%, and leaving it at that new setting. If the test at line 20 gives the opposite results, the system at line 22 issues a similar command to decrement the secondary feed, and ends the if procedure at line 24. At line 26, Appendix 10, the system releases the new secondary feed valve settings for use by the system, whereby the system can now carry out the command to change the setting of the secondary feed valve, and at line 28 the feed adjustment task ends.

One example of station blending data useful in FIG. 2, step 68 and resulting from carrying out a procedure such as discussed in connection with Appendix 3, is illustrated in Appendix 11 and has been found useful in said Hinesburg Sand and Gravel installation. Referring to Example 11, the first table shows where a donor station can be used. This is in answer to the test at FIG. 2, step 68. For example, if station 7 has satisfied the direct needs for product during a given 25-second cycle, it can become a donor station whose output is useful as a blend component to substitute for the missing output of station 5 or of station 6 or of station 8 or of station 9. The second table in Appendix 8 shows what blends are needed for the particular empty stations and in what proportions the blend components ought to be mixed. For example, if station 4 is empty, its missing output can be substituted by a blend of the materials from stations 3, 5 and 6, provided of course that each of those three stations is available at the relevant time as a donor station having satisfied its direct requirements to the products, and the blend of stations 3, 5 and 6 should be in mass percentages of 23, 42, 35, respectively. In the case of stations such as 9, the missing output can be substituted by the outputs from station 8 only, or from station 10 only, or from a combination of the materials from stations 7 and 11 or from a combination of the materials from stations 8 and 10. Of course, if station 8 alone or station 10 alone is used, 100 mass percent of its output goes to make up for the missing output of station 9. If a blend from stations 7 and 11 is used the mass percentage blend should be 43 from station 7 and 57 from station 11. If a blend from stations 8 and 10 is used instead, the mass percentages are 52 and 48 respectively.

If the test at FIG. 2, step 68 determines that a given station can become a donor, and the FIG. 2 process goes to step 76, the system in effect looks up a table such as the first table in Appendix 11 to determine in what blends the donor station can be used. For example, if the donor station which has reached step 76 in FIG. 2 is station 7, this step will determine that it can be used as a blend for substituting the missing output of any one of stations 5, 6, 8 and 9. The system next determines which ones of the possible blends is in greatest need; in this example the system finds which, if any, of stations 5, 6, 8 and 9 is in greatest demand, i.e., which one is empty and is most needed for a product. One test for greatest need is to determine which of the several empty stations has a lowest ratio of actual valve open time over required valve open time in the current 25-second cycle. The system next checks the neediest empty station to see if the other components of the blend are also available. In the example of station 5 being the neediest, the system in effect looks at a table such as the second table in Appendix 11 and finds that in addition to donor station 7, empty station 5 needs stations 4 and 6. If stations 4 and 6 cannot be donor stations at this time, because they have not yet satisfied the direct requirements of products into which they are mixed, the system goes back to the first table in Appendix 11 and, assuming the next neediest empty station is 6, finds out if, in addition to donor station 7, stations 5 and 8 are available at this time as donor stations. The first time that is true, e.g. if it happens to be true for station 6, the system uses the right-hand column of the second table in Appendix 11 to find the necessary proportions of the blend components (in this case 24, 31 and 45% respectively for donor stations 5, 7 and 8), computes the relative times the valves from stations 5, 7 and 8 should be open to make the required blend such that no one valve is open for more than 2.5 seconds and enters a procedure similar to that commencing with step 62 of FIG. 2 to cause stations 5, 7 and 8 to start supplying material in a blend to make up for the output of station 6 which is unavailable at this time. This continues for up to 2.5 seconds but, for any one of stations 5, 7 and 8 it can end earlier if the required valve open time for the respective station is less than 2.5 seconds or if the station becomes empty within its required valve open time. When the blending from stations 5, 7 and 8 in this example ends, the system credits the ACTM of station 6 (the empty station) with the time increment corresponding to the substituted blended mass, and deducts from the ACTM of stations 5, 7 and 8 in this example the times they were open while blending the substitution material for station 6.

In this manner the system can often make up for the missing output of an empty station from material available at other stations without the need to restore balance as between the stations through dumping overflowing stations into the waste product as to give the classification tank time to build up material into the empty station and without necessarily waiting for the secondary feed to preferentially supply the empty station. This meets one of the main goals of the invented system of optimizing substantially concurrent production of the two controlled products while using the feed material as much as possible to make controlled products and as little as possible to make waste by-product.

The valve timing task referred to in connection with FIG. 2, step 64 is illustrated in Appendix 12 and is entered only when FIG. 2, step 62 determines that the remaining required valve open time is less than the upcoming 2.5-second subcycle. The task of Appendix 12 starts upon the posting of the interrupt indicated at FIG. 2, step 64 and, at line 12 sets a timer to the remaining required valve open time (to an interval of less than 2.5 seconds). When the short interval expires at line 14, the task of Appendix 12 sets at line 16 a simulated station-empty interrupt, and ends at line 18. This station-empty interrupt is received at FIG. 2, step 66 so that the procedure of FIG. 2 can enter the remainder of step 66 (closing the valve in question, recording absolute time, etc.).

The exemplary system described above can be implemented as an integral combination of classification tank equipment of the type used at said Hinesburg Sand and Gravel facility and a general purpose computer system programmed and arranged to carry out the functions described above and interfaced with the classification tank valves as indicated in FIG. 1 and discussed above. A computer such as one made by IBM under the commercial designation Series 1, Model 4955, having memory and peripheral equipment sufficient for the functions indicated above, can be used, but any other similar machine can be used instead so long as it is programmed, arranged and interfaced to carry out the functions described above as applicants' best mode known at the time of execution of this application of an example of carrying out their invention. Because the relevant sequences of steps have been described above for conciseness and easier understanding in functional terms, they can be translated to the language suitable for a particular computer system by a person of ordinary skill in the art more easily than if described in a particular formal computer language suitable for another machine. In the alternative, some or all of the functions described above can be implemented instead by respective hard- or firm-wired systems, the choice of whether to firm- or hard-wire a particular function versus having it carried out by a suitably programmed, arranged and interfaced general purpose computer system depending solely on commercial and engineering factors such as relative cost, reliability, ease of serviceability, etc.

The system described above can make use of automatic station gradation sampling by conventional on-line equipment attached to the station outlets. Such gradation sampling equipment can be activated in accordance with the invention at the end of each 25-second cycle (or at longer intervals) and can provide the quantities A(i,j), discussed above in connection with Appendix 5, input 1 so that the automatically provided station gradation can be used in the remainder of the procedure discussed in connection with Appendix 5.

It should be understood that the description above is only of a particular example of use of the inventive principles, and that the scope of the invention is defined by the appended claims and is not limited to the particular example described in detail.

APPENDIX 1

MASTER SEQUENCE

START 1
10 OPEN CONTROL DATA FILE
12 CYCLE CONTROL PARAMETERS (SUBCYCLE = 2.5 SEC, CYCLE = 25 SEC, LONG TERM CYCLE = 4 × 25 SEC, BALANCING INTERVAL = 12 × 25 = 300 SEC)
14 PRODUCT MIX PARAMETERS (APPENDIX 2)
16 STATION BLENDING DATA (APPENDIX 3 AND APPENDIX 11)
18 WATER/FEED BALANCE (APPENDIX 4)
20 PREPARE FOR PLANT OPERATION
22 DEACTIVATE STATION SENSORS
13 CLOSE ALL STATION OUTFLOW VALVES
26 RESET STATION SENSOR INTERRUPTS
28 OPERATE PLANT
START 2
30 ATTACH STATION OUTFLOW VALVE CONTROL TASKS (FIG. 2)
32 ATTACH QUALITY-CONTROL TASK (APPENDIX 5)
34 ATTACH PRODUCT-BALANCING TASK (APPENDIX 6)
35 ATTACH VALVE WASHING TASK
36 DO UNTIL HALT INTERRUPT IS POSTED BY PLANT OPERATOR
38 POST NEWSET INTERRUPT (APPENDIX 7)
42 START OF A LONG TERM CONTROL CYCLE N×T (N=4, T=25 SEC)
44 LOOP N TIMES
46 SET 25 SEC TIMER; 2.5 SEC TIMER (FOR STATION-EMPTY INTERRUPTS)
48 ACTIVATE STATION SENSORS
50 WAIT FOR 25 SEC TIMER TO EXPIRE
52 DEACTIVATE STATION SENSORS
54 UPDATE ACTM (I,J) FOR THE JUST-ENDED 25 SEC CYCLE
56 RESET STATION SENSOR INTERRUPTS

APPENDIX 1-continued

MASTER SEQUENCE

58 IF (CHANGES NOT READY)
60 THEN: GO TO END LOOP
62 ELSE: APPLY CHANGES TO PLANT SETTINGS, SET CHANGES TO NOT READY
64 END LOOP
66 POST UPDATE INTERRUPT TO CALL MATERIAL/PRODUCT UPDATE TASK (APPENDIX 3)
68 CALL NEWSET (APPENDIX 7)
70 PRINT OUT REPORT TO PLANT OPERATOR
72 END DO
74 STOP

APPENDIX 2

PRODUCT MIX PARAMETERS DERIVATION

Inputs:

(1) design gradations for desired product; B(i) is the % of product made of particles of size (i); i = 1,2,. . .,12
(2) station gradations: A(i,j) is the % of particle of size (i) in the material at station (j); i = 1,2,. . .,12; j = 1,2, . . . ,12
(3) material outflow rate; W(j) is the rate in tons/sec. through an open value of station (j)
(4) material available; MAT(j) is the material available at station (j)
(5) maximum permissible deviations LMT(i) from the (i) gradations in the product (e.g., .5% for each (i))

Derivation:

LP minimization of Z = SUM [V(k)] for k = 1,2,. . .,48 subject to following conditions, where T(j) is the sought open valve time for station (j)

(1) A(1,1).W(1).T(1) + A(1,2).W(2).T(2) + . . . + + A(1,12).W(12).T(12) + V(1) − V(2) = B(1)

. . . . . .

(12) A(12,1).W(1).T(1) + A(12,2).W(2).T(2) + . . . + + A(12,12).W(12).T(12) +V(23) − V(24) = B(12)

(13–24) A(j)T(j) ≦ MAT(j) for j = 1,2, . . . ,12

(25–48) V(k) ≦ LMT(k) for k = 1,2,. . .,48 positive deviations

Result:

The valve open times T(1), T(2),. . ., T(12) for the stations needed to make the design product;
For product (i), REQ(i, j) = T(i)

Note: The period between quantities [e.g., A(1,1).W(1).T(1)] denotes a multiplication.

APPENDIX 3

STATION BLENDING DATA DERIVATION

Inputs:

(1) gradations A(i,N) for empty station N whose missing output is to be substituted by a blend from donor stations
(2) gradations A(i,j) for the other 11 potential donor stations
(3) material flow rates W(j)
(4) amount of blended material to be substituted, e.g. for 1 sec. this is W(N)

Derivation:

LP minimization of Z = V(1,1) + V(1,2) + . . . + V(12,1) + V(12,2) subject to following conditions, excluding terms for station N from the left-hand side of the expressions, to find BT(j);

(1) A(1,1).W(1).BT(1) + A(1,2).W(2).BT(2) + . . . + + A(1,12).W(12).BT(12) + V(1,1) − V(1,2) = A(N,1).W(N).1

. . . . . .

(12) A(12,1).W(1).BT(1) + A(12,1).W(2).BT(2) + . . . + + A(12,12).W(12).BT(12) + V(12,1) − V(12,2) = A(N,12).W(N).1

(13–36) V(1,m) < .1 [A(N,1).W(N)] for 1 = 1,2,. . .,12; m = 1,2

Result:

BT(j) for BT(N) = −1 sec;
BT(j) is the set of times the outflow valves for the respective stations (j) must remain open to blend one second worth of the missing output of empty station j = N

APPENDIX 4

WATER/FEED BALANCE (1) MAT is the feed (primary and secondary) in tons/hr.
(2) W(i,j) is the flowrate in ton/sec. from stations (j) into products (i)
(3) T(i,j) is the time in sec./hr. the valve of station (j) feeding product (i) has been open over the last 300-sec. cycle
(4) Then MAT = SUM [W(i,j).T(i,j)] for i = 1, 2, 3; j = 1, 2,. . .,12
(5) The following water/feed balance conditions have been found empirically tobe satisfactory

| (MAT) Feed | Water in gal./min. | | % opening of recycled water | valve/ material | overflow valve |
|---|---|---|---|---|---|
| tons/hr. | Primary | Recycled | Station 1 | Station 2 | Station 3 |
| 80 | 400 | 1,000 | 80/20 | 60/40 | 0/40 |
| 120 | 400 | 1,100 | 80/20 | 60/40 | 0/40 |
| 160 | 500 | 1,200 | 80/20 | 60/40 | 10/40 |
| 200 | 600 | 1,400 | 80/25 | 60/45 | 15/45 |
| 220 | 600 | 1,600 | 80/30 | 70/50 | 20/50 |

APPENDIX 5

QUALITY CONTROL TASK

Inputs:

(1) Station gradations: A(i,j) is the mass % of particles of size (i) in the material at station (j); i = 1,2,. . .,12
(2) desired product gradation specifications: B(i) is the mass % of particles of size (i) in the desired product; i = 1,2,. . .,12
(3) actual product gradation: C(i) is the mass % of particles of size (i) in the product as tested; i = 1,2,. . .,12
(4) desired gradation change dB(i) = [ B(i) − C(i) ] for i = 1,2,. . .,12
(5) material outflow rates from station valves: W(j) for j = 1,2,. . .,12
(6) material outflow rates from station valves for period of quality-control sample: T(j) for j = 1,2,. . .,12
(7) total value opening time for station outflow valves: TOT(j) for j = 1,2,. . .,12

Derivation:

LP minimization of Z = SUM [V(k)] for k = 1,2,. . .,24, where V(k) are random deviations to allow for sampling error, and subject to following conditions:

(1) A(1,1)W(1)dT(1,1) + A(1,1)W(1)dT(2,1) + . . . + + A(1,12)W(12)dT(1,12) + A(1,12)W(12)dT(2,12) + + V(1) − V(2) = dB(1)

. . . . . .

(12) A(12,1)W(1)dT(1,1) + A(1,2)W(1)dT(2,1) + . . . + + A(1,12)W(12)dT(1,12) + A(12,12)W(12)dT(2,12) + + V(23) − V(24) = dB(12)

(13–36) V(k) ≦ LMT(k) where LMT = (approx. .05) for k = 1,24 possible random variations (37–48) dT(1,j), j = 1,12 ≦ TOT(j) − T(j)

(49–60) dT(2,j), j = 1,12 ≦ T(j)

Result:

Changes dT(1,j) in value open lines for j = 1,2,. . .,12 stations for 1 = 1,2 where 1 = 1 means positive correction and 1 = 2 means a negative correction Note: This result is used separately for each product, and the two products are balanced (per Appendix 6).

APPENDIX 6

PRODUCT BALANCING

Inputs:

(1) W(j) is the available rate of flow in tons/sec. through a valve of station (j)
(2) T(i,j) is the time in seconds over which the outflow valve from station (j) to product (i) should remain open to blend product (i) per product mix parameters (Appendix 2)
(3) MAT(j) is the material which flows out of station (j) over a 25-sec. cycle, found as an average over the last 4, 25-sec. cycles Derivation:

LP maximizing of Z = [T(1,1)W(1) + T(1,2)W(2) + . . . + T(1,12)W(12)] PRD(1) +

APPENDIX 6-continued

PRODUCT BALANCING

+ [T(2,1)W(1) + T(2,2)W2 + . . . + T(2,12)W(12)] PRD(2)
Subject to the following conditions:
(1) T(1,1)W(1)PRD(1) + T(2,1)W(1)PRD(3) ≦ MAT(1)
. . . . . .
(12) T(1,12)W(12)PRD(1) + T(2,12)W(12)PRD(2) ≦ MAT(12)
Result:
PRD(i) for i = 1,2 products (the relative shares of the two controlled products)

APPENDIX 7

NEWSET (NEW PLANT SETTINGS)

```
10   WAIT FOR NEWSET INTERRUPT
12   RESET NEWSET
121  POST INTERRUPT TO OPEN WASH VALVES
122  RESET INTERRUPT TO CLOSE WASH VALVES
14   IF PLANT OPERATOR HAS POSTED A HALT, THEN
     GO TO END
16   ELSE, ENQ. DATSET
18   IF QC FLAG NOT POSTED (NO QUALITY CONTROL
     RESULTS ARE AVAILABLE,
     THEN GO TO BALPRD
20   ELSE, CALL QUALITY CONTROL TASK (APPENDIX 5)
22   END IF
24   BALPRD    CALL PRODUCT BALANCING TASK
               APPENDIX 6)
26             POST HSTADJ INTERRUPT TO CALL
               HISTORICAL ADJUSTMENTS
               TASK (APPENDIX 9)
28             POST ADJUST INTERRUPT TO CALL
               FEED ADJUSTMENT
               TASK (APPENDIX 10)
30             CALL WATER/FEED BALANCE TASK
               APPENDIX 4)
32             DEQ DATSET
34             SET CHANGE = YES
341  POST INTERRUPT TO CLOSE WASH VALVES
342  RESET INTERRUPT TO OPEN WASH VALVES
36   END
```

APPENDIX 8

MATERIAL/PRODUCT UPDATE TASK

```
10  WAIT FOR UPDATE INTERRUPT (APPENDIX 1)
12  RESET UPDATE
14  BEGIN    ENQ DATSET
16           INCREMENT CYCLE INDICES OF CIRCULAR
             FILE FOR 100-SEC. PERIOD FOR THE
             4, 25-SEC. CYCLES
             WHICH HAVE JUST
             EXPIRED; [ACTM (i,j)]
18           COMPUTE NEW 100-SEC. PERIOD TOTALS
             ACTUAL OPEN TIMES OF ALL
             STATION/PRODUCT COMBINATIONS
20           COMPUTE NEW 300-SEC. CYCLE TOTALS FOR
             ALL STATION/ PRODUCT COMBINATIONS
22  END DEQ DATSET
24  END UPDATE
```

APPENDIX 9

COMPUTE HISTORICAL ADJUSTMENTS TASK

```
10  WAIT FOR HSTADJ INTERRUPT
12  ENQ DATSET
14  COMPUTE EXCESS OR DEFICIT FOR
    100-SEC. CYCLE FOR EACH STA-
    TION/PRODUCT COMBINATION
    DELTA(i,j) = SUM [ACTM(i,j)] − SUM [REQ(i,j)]
16  POSITIVE DELTA MEANS EXCESS
18  NEGATIVE DELTA MEANS DEFICIT
20  ADD DELTA (i,j) TO PREQ (i,j)
22  END DEQ DATSET
```

APPENDIX 10

FEED ADJUSTMENT TASK

```
10  WAIT FOR ADJUST INTERRUPT (APPENDIX 7)
12  ENQ DATSET
14  SUPPLY (1) = SUM [ACTM(i,1-6)W(i,1-6)] FOR
    LAST 100-SEC. CYCLE
16  SUPPLY (2) = SUM [ACTM(i,7-12)W(I,7-12)] FOR
    LAST 100-SEC. CYCLE
18  COMPUTE RATIO [SUPPLY (2)/SUPPLY (1)]
20  IF RATIO LESS THAN 99.5% OF THE SAME RATIO
    FOR REQ, INCREMENT SECONDARY FEED
22  ELSE, IF RATIO GREATER THAN 100.5%,
    DECREMENT SECONDARY FEED
24  END IF
26  DEQ DATSET
28  END ADJUST TASK
```

APPENDIX 11

EXAMPLE OF SUBSTITUTION BLENDS

| Donor Station: | The donor station can be used as a component in a blend equivalent to the output of station(s): |
|---|---|
| 1 | 2 |
| 2 | 1, 3 |
| 3 | 2, 4 |
| 4 | 3, 5 |
| 5 | 4, 6 |
| 6 | 4, 5, 7 |
| 7 | 5, 6, 8, 9 |
| 8 | 6, 7, 9 |
| 9 | 7, 8, 10 |
| 10 | 9, 11, 12 |
| 11 | 9, 10 |
| 12 | 11 |

| Station whose missing output is to be substituted by a blend: | Blend made up from stations: | Blend component proportions (mass %) |
|---|---|---|
| 1 | 0 (none) | |
| 2 | 1, 3 | 44, 56 |
| 3 | 2, 4 | 40, 60 |
| 4 | 3, 5, 6 | 23, 42, 35 |
| 5 | 4, 6, 7 | 18, 51, 31 |
| 6 | 5, 7, 8 | 24, 31, 45 |
| 7 | 6, 8, 9 | 38, 22, 40 |
| 8 | 7, 9 | 33, 67 |
| 9 | [8], [10], [7,11], [8,18] | [43, 57], [52, 48], |
| 10 | [9], [11], [9, 11] | [47, 53] |
| 11 | [10], [12], [10, 12] | [50, 50] |
| 12 | [10], [11], [10, 11] | [54, 46] |

APPENDIX 12

VALVE TIMING TASK

```
10  WAIT FOR INTERRUPT (FIG.2 -- WHEN VALVE
    SHOULD REMAIN OPEN FOR AN INTERVAL LESS
    THAN 2.5 SEC.
12  SET TIMER TO THE INTERVAL
14  WAIT FOR TIMER TO EXPIRE
16  POST STATION-EMPTY INTERRUPT
18  END TASK
```

NOTE: THERE ARE 12 VALVE TIMING TASKS, ONE FOR EACH STATION.

We claim:

1. A system for controlling a plant having a material classifier fed with source material at least from a primary source and having several stations each receiving material constituents characterized by respective particle-size distributions and further having sensors detecting the presence of material at the respective stations and valves controlling the flow of material from the respective stations to at least one controlled product outlet and at least one by-product outlet comprising:

process control means responsive to signals from said sensors to open and/or close selected ones of said valves at times causing material having a selected respective particle-size distribution to flow from said classifier into each controlled product outlet; and said process control means including means for monitoring selected plant operation parameters and for changing the absolute and relative open times of said valves in response to changing conditions during plant operation to maintain high flowrate of material into the at least one controlled material outlet relative to the flowrate into the at least one by-product outlet.

2. A system as in claim 1 in which said plant includes at least two controlled material outlets and said valves selectively control the flow of material from the respective stations to each of said at least two controlled material outlets, and the process control means include means for opening and closing said valves at respective times causing material having respective selected particle-size distributions to flow from said classifier to each of said at least two controlled material outlets at respective selected rates.

3. A system as in claim 2 in which the process control means comprise means for opening and closing said valves at times causing the balance as between the materials flowing into two controlled material outlets to vary in response to changing conditions during plant operation to maintain high overall flow into the controlled material outlets relative to overall flow into the one or more by-product outlets.

4. A system as in claim 1 or 2 in which the process control means comprise means for opening and closing said valves at times regulating the flow to each controlled material outlet in accordance with the flow of material to the material classifier from at least said primary source.

5. A system as in claim 1 in which said process control means comprise means for opening and closing the valves at respective times selected to substantially maximize said flow to each controlled material outlet and to substantially minimize flow of material from the respective stations to said one or more by-product outlets.

6. A system as in claim 5 in which the process control means include means for varying the ratios of flowrates from the respective stations to said controlled material outlet to maximize overall flow of material to at least a selected one of said one or more controlled material outlets.

7. A system as in claim 1, 2 or 3 including means for determining when a station has satisfied at the time the direct needs of said one or more controlled products so that it can be used as a donor station providing material to serve as a substitute for that from a station which at the time is empty, determining which if any needed stations are empty and which among them are in greatest need of material, and substituting for the missing output of the neediest empty station a blend of the output of one or more other stations which at the time can serve as donor stations to maintain the design specifications of said one or more controlled products.

8. A method of operating a classification plant comprising the steps of:

dividing feed material by particle-size into several stations;

feeding the station contents into respective one or more controlled products in proportions determined by respective controlled product particle-size design requirements and allowing excess station contents to be fed into waste by-product;

machine-monitoring the flow of material from the individual stations into the respective products; and automatically machine-adjusting the open times of valves through which material flows from the respective stations into the products to optimize utilization of the feed material for the controlled products rather than the by-product.

9. A method as in claim 8 in which the machine-adjusting step comprises using the outflow of one or more stations which at the time have enough material to meet the direct needs of the controlled products to substitute for the needs of one or more controlled products for material from a station which at the time does not have sufficient material in a manner which substantially maintains the design requirements of the respective one or more controlled products.

10. A method as in claim 8 or 9 including machine-monitoring the rate of flow of feed material to the stations and machine-adjusting said rate to optimize utilization of the feed material for the controlled products.

11. A method as in claim 10 in which said feed material is supplied from a primary source and at least one secondary source, and said adjusting of feed flowrate comprises adjusting at least the rate of flow of secondary source material to the stations.

12. A method as in claim 8 or 9 in which said dividing of feed material takes place in a classification tank supplied with water from a primary source and with recycled water, and including the step of machine-adjusting the water flow to the tank to optimize production of the controlled products.

* * * * *